US006920736B2

(12) United States Patent
Miyazaki

(10) Patent No.: US 6,920,736 B2
(45) Date of Patent: Jul. 26, 2005

(54) GOODS-WRAPPING APPARATUS INCLUDING A PRINTER

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/612,969

(22) Filed: Jul. 7, 2003

(65) Prior Publication Data

US 2004/0093830 A1 May 20, 2004

Related U.S. Application Data

(62) Division of application No. 09/731,029, filed on Dec. 7, 2000, now Pat. No. 6,615,714.

(30) Foreign Application Priority Data

Dec. 7, 1999 (JP) ..... 11-348122

(51) Int. Cl.[7] ..... B65B 43/14; B65B 57/12

(52) U.S. Cl. ..... 53/64; 53/131.4; 53/571

(58) Field of Search ..... 53/64, 66, 504, 53/571, 411, 131.4

(56) References Cited

U.S. PATENT DOCUMENTS 3,190,054 A * 6/1965 Arnold et al. ..... 53/131.4
3,765,326 A * 10/1973 Hawkins ..... 53/131.4
4,073,122 A * 2/1978 Areson ..... 53/131.4
5,474,392 A 12/1995 Matsuoka
5,555,703 A * 9/1996 Gombault et al. ..... 53/411
5,771,657 A * 6/1998 Lasher et al. ..... 53/131.4
5,806,992 A 9/1998 Ju
5,839,257 A * 11/1998 Soderstrom et al. ..... 53/131.5
6,033,114 A 3/2000 Grimm et al.
6,112,502 A * 9/2000 Frederick et al. ..... 53/411
6,371,645 B1 4/2002 Rusert et al.
6,375,297 B1 4/2002 Hayashi et al.
6,397,558 B1 * 6/2002 Yuyama et al. ..... 53/131.4
6,405,869 B1 * 6/2002 Whittemore et al. ..... 206/497
6,421,073 B1 7/2002 Dietel et al.
6,470,648 B1 * 10/2002 Baker ..... 53/411

FOREIGN PATENT DOCUMENTS

| | | |
|---|---|---|
| DE | 04033512 A | 4/1992 |
| JP | 057006974 A | 1/1982 |
| JP | 07125728 A | 5/1995 |
| JP | 08119237 A | 5/1996 |

* cited by examiner

*Primary Examiner*—John Sipos
(74) *Attorney, Agent, or Firm*—Sughrue Mion, PLLC

(57) ABSTRACT

According to the present invention, a goods-wrapping apparatus for wrapping a particular article of a plurality of articles, includes: a goods storing section operable to store the plurality of articles; a goods carrying in/out section operable to carry in the articles into the goods storing section and carry out the article from the goods storing section; a printer operable to print a printing content associated with the particular article onto a printing medium based on the particular article; and a wrapping section operable to wrap the particular article carried out from the goods carrying in/out section with the printing medium onto which the printing content associated with the particular article has been printed.

7 Claims, 11 Drawing Sheets

| No | NAME OF ITEM | MAKER | PRICE | NUMBER OF GOODS IN STOCK | CONTENT |
|---|---|---|---|---|---|
| ⋮ | ⋮ | ⋮ | ⋮ | ⋮ | ⋮ |
| 20 | CAMERA | A | 5,600 | 3 | LOGO1 |
| ⋮ | ⋮ | ⋮ | ⋮ | ⋮ | ⋮ |

FIG. 5

| No | MAKER | CONTENT1 | CONTENT2 |
|---|---|---|---|
| ⋮ | ⋮ | ⋮ | ⋮ |
| 7 | A | LOGO1 | LOGO 2 |
| ⋮ | ⋮ | ⋮ | ⋮ |

FIG. 6

GOODS-WRAPPING APPARATUS INCLUDING A PRINTER

This is a divisional of application Ser. No. 09/731,029 filed Dec. 7, 2000; now U.S. Pat. No. 6,615,714 the disclosure of which is incorporated herein by reference.

This patent application claims priority from a Japanese patent application No. H11-348122 filed on Dec. 7, 1999, the contents of which are incorporated herein by reference.

BACKGROUND OF THE INVENTION

1. Field of the Invention

The present invention relates to a printer that prints a printing content onto a printing medium and a goods-wrapping apparatus including such a printer. In particular, the present invention relates to a goods-wrapping apparatus that wraps a particular article of a plurality, a printer included in the goods-wrapping apparatus, and a bag onto which the printer prints a predetermined printing content.

2. Description of the Related Art

There is a known goods-trading apparatus that selects a particular article of a plurality stored therein and carries the selected article out. As the goods-trading apparatus, for example, a canned juice vending machine, a confectionery vending machine, a newspaper vending machine, and a flower vending machine are put into practical use. Such a vending machine can store a plurality of articles and carry out one of the articles selected by a user. Moreover, the goods-trading apparatus allows the user to purchase a desired article even in the middle of the night, early morning, or holidays when shops are closed, because it can automatically carry out the article selected by the user in accordance with the user's instruction.

In many cases, however, the article purchased via the conventional goods-trading apparatus mentioned above is covered only by a package of the article. Thus, the package may be stained while the user carries the purchased article.

On the other hand, there are known plural types of printers for printing a desired printing content onto a printing medium. However, such conventional printers can perform printing only onto a predetermined printing medium, that is, for example, a standard-sized sheet of paper. Thus, it is difficult for the conventional printer to perform the printing onto a given printing medium other than the predetermined printing medium.

SUMMARY OF THE INVENTION

Therefore, it is an object of the present invention to provide a goods-trading apparatus with a printer that can solve the above-mentioned problems. This object is achieved by combinations described in the independent claims. The dependent claims define further advantageous and exemplary combinations of the present invention.

The inventor of the present invention came to appreciate that the known goods-trading apparatus had the following problems. First, the article that is carried out from the goods-trading apparatus is not wrapped with wrapping paper or the like. Thus, it is hard for the user to take the purchased article. Second, since the purchased article is not wrapped, it is difficult for the purchaser to be satisfied even if the article is the same as an article available from a shop.

In order to solve the aforementioned problems, the goods-trading apparatus of the present invention includes a means operable to pack the article selected by the user into a bag and carry it out. Moreover, the goods-trading apparatus of the present invention uses, as the bag for packing the article, a bag onto which a printing content related to the article to be packed is printed. Furthermore, the goods-trading apparatus of the present invention includes a printer operable to print the printing content onto the bag.

According to the first aspect of the present invention, a printing device for printing a printing content onto a bag having an opening and a closed portion opposite to the opening is provided. The printing device includes: a transport mechanism operable to transport the bag; and a printing head operable to print the printing content onto the bag that is being transported by the transport mechanism in such a manner that the closed portion goes at the head of the bag. The bag may be a paper bag or a fabric bag. In addition, the bag may be folded at the bottom thereof. The printing content may be a perceptible content, such as an image or a character.

The printing device may further include: a transport direction determination section operable to determine whether or not the bag is transported in such a manner that the closed portion goes at the head of the bag; and a warning section operable to warn, in a case where the bag cannot be transported in such a manner that the closed portion goes at the head of the bag, that the bag cannot be transported in such a manner that the closed portion goes at the head of the bag. For example, the warning section may produce a display device that presents a display image for warning that the bag is not to be transported in such a manner that the closed portion goes at the head of the bag. Also, the warning section may output, to a functional block of the printing device, a signal indicating that the closed portion does not go at the head of the bag. The transport direction determination section may detect a mark indicating a direction in which the bag is to be transported and determines whether or not the bag can be transported in such a manner that the closed portion goes at the head of the bag, the mark being provided on the bag. For example, the transport direction determination section may include a capturing device such as a CCD or a line sensor and detect the mark based on image data captured by the capturing device. In addition, the mark may be a bar code while the transport direction determination section may be a bar code reader.

The printing device may further include: a bag size determination section operable to determine a size of the bag; and a print size adjustment section operable to adjust a size of the printing content to be such a size that the printing content is printed onto the bag, based on the size of the bag determined by the bag size determination section. For example, the bag size determination section may include a capturing device such as a CCD or a line sensor and detect the size of the bag based on the size of the bag captured by the capturing device. The bag size determination section may detect a mark indicating the size of the bag provided on the bag and detect the size of the bag based on the determination result. The mark provided on the bag may be a bar code including information regarding the size of the bag. Moreover, the printing device further includes: a plurality of printing heads having different printing characteristics; a material discriminator operable to discriminate a material for the bag; and a head selector operable to one of the printing heads in accordance with the material for the bag.

The material discriminator may detect a mark indicating the material for the bag provided on the bag and discriminate the material for the bag based on the detection result. The mark provided on the bag may be a bar code including information indicating the material for the bag and the material discriminator may detect the information of the material for the bag included in the bar code. In addition, the plurality of printing heads may be a printing head using ink for both paper and fabric.

The printing device further includes a condition adjustment section operable to change a position of the bag with respect to the direction in which the bag is transported so as to allow the bag to be transported in such a manner that the closed portion goes at the head of the bag, in a case where the bag cannot be transported in such a manner that the closed portion goes at the head of the bag. For example, the condition adjustment section may change a position of the bag to such a position that the closed portion of the bag goes at the head of the bag and a surface of the bag onto which the printing content is to be printed faces the printing head. More specifically, in a case where a handle of a paper bag is positioned at the head thereof, the condition adjustment section may rotate the paper bag by 180 degrees so as to make the closed portion of the paper bag positioned at the head of the paper bag. In addition, the mark provided on the bag may be a bar code while at least one of the transport direction determination section, the bag size determination section, and the material discriminator may be a bar code reader. Furthermore, the printing device further includes a bag storing section operable to store the bag, and the transport direction determination section detects whether or not the bag is stored in a direction in which the closed portion can go at the head of the bag and determines whether or not the bag can be transported in such a manner that the closed portion goes at the head of the bag based on the detection result.

According to the second aspect of the present invention, a printing device for printing a printing content onto a bag having an opening and a closed portion opposite to the opening is provided. The printing device includes: a printing head operable to print the printing content onto the bag; and a mark detector operable to make the printing head print the printing content onto the bag when the mark detector detects a mark indicating that the printing content is printable provided on the bag.

In an embodiment of the second aspect of the present invention, the printing device further includes: a printing position detector operable to detect a mark specifying a printable position at which the printing content is printable, the mark being provided on the bag; and a head moving section operable to move the printing head to an escape position at a position different from the printable position.

According to the third aspect of the present invention, a printing device for printing a printing content onto a printing medium is provided. The printing device includes: a thickness detector operable to detect a thickness of the printing medium; a printing head operable to print the printing content onto the printing medium; and a head moving section operable to move the printing head in accordance with the thickness of the printing medium detected by the thickness detector.

The head moving section may move the printing head to an escape position in a case where the thickness of the printing medium is thicker than a predetermined thickness. In addition, the printing device further includes: a transport roller section operable to transport the printing medium while putting the printing medium between a first roller and a second roller which is opposite to the first roller; and a roller-interval adjuster operable to adjust an interval between the first roller and the second roller in accordance with the thickness of the printing medium. Moreover, the printing device further includes a communication section operable to input the printing content via a network.

According to the fourth embodiment of the present invention, a bag onto which a printing content is printed by a printing device is provided. The bag includes a mark for the printing device that indicates that the printing content is printable. The bag may include a mark indicating a material for the bag. The mark may be a bar code. The bag may have a printing layer in accordance with a printing technology adopted to the printing device. As the printing layer, a printing layer for ink-jet printing, a thermal coloring layer, a photo-fixing thermal coloring layer, a printing layer for thermal ink transfer printing, and a printing layer for dye sublimation printing may be used.

According to the fifth embodiment of the present invention, a goods-wrapping apparatus for wrapping a particular article of a plurality of articles is provided. The goods-wrapping apparatus includes: a goods storing section operable to store the articles; a goods carrying in/out section operable to carry the articles into the goods storing section and carry the articles out from the goods storing section; a printer operable to print a printing content associated with the particular article onto a printing medium based on the particular article; and a wrapping section operable to wrap the particular article carried out from the goods carrying in/out section with the printing medium onto which the printing content associated with the particular article has been printed.

In an embodiment of the present invention, the printer includes: a goods database operable to store information related to the articles; a printing contents data base operable to store printing contents respectively associated with the articles; a printing content generator operable to select a printing content from the printing contents database and generate the printing content associated with the particular article to be printed on the printing medium, based on the particular article and the goods database; and a printing section operable to print the printing content associated with the particular article generated by the printing content generator on to the printing medium. In addition, the printing medium may be a bag. In this case, the wrapping section may include a packing mechanism operable to pack the particular article into the bag onto which the printing content associated with the particular article has been printed. The goods-wrapping apparatus may further include a communication section operable to receive/transmit information from/to an external device. In this case, the goods-wrapping apparatus is capable of receiving/transmitting at least one of the printing contents and information regarding the articles that are stored in the external device via the communication section.

This summary of the invention does not necessarily describe all necessary features so that the invention may also be a sub-combination of these described features.

BRIEF DESCRIPTION OF THE DRAWINGS

While the specification concludes with claims particularly pointing out and distinctly claiming the subject matter which is regarded as the invention, it is believed that the invention, the object, features and advantages thereof will be better understood from the following description taken in connection with the accompanying drawings in which:

FIG. 5 shows an example of goods information stored in a goods database 30;

FIG. 6 shows an example of printing content information stored in a contents database 32;

DETAILED DESCRIPTION OF THE PREFERRED EMBODIMENTS

The invention will now be described based on preferred embodiments, which do not intend to limit the scope of the present invention, but rather to exemplify the invention. All of the features and the combinations thereof described in the embodiments are not necessarily essential to the invention.

Figure 1:
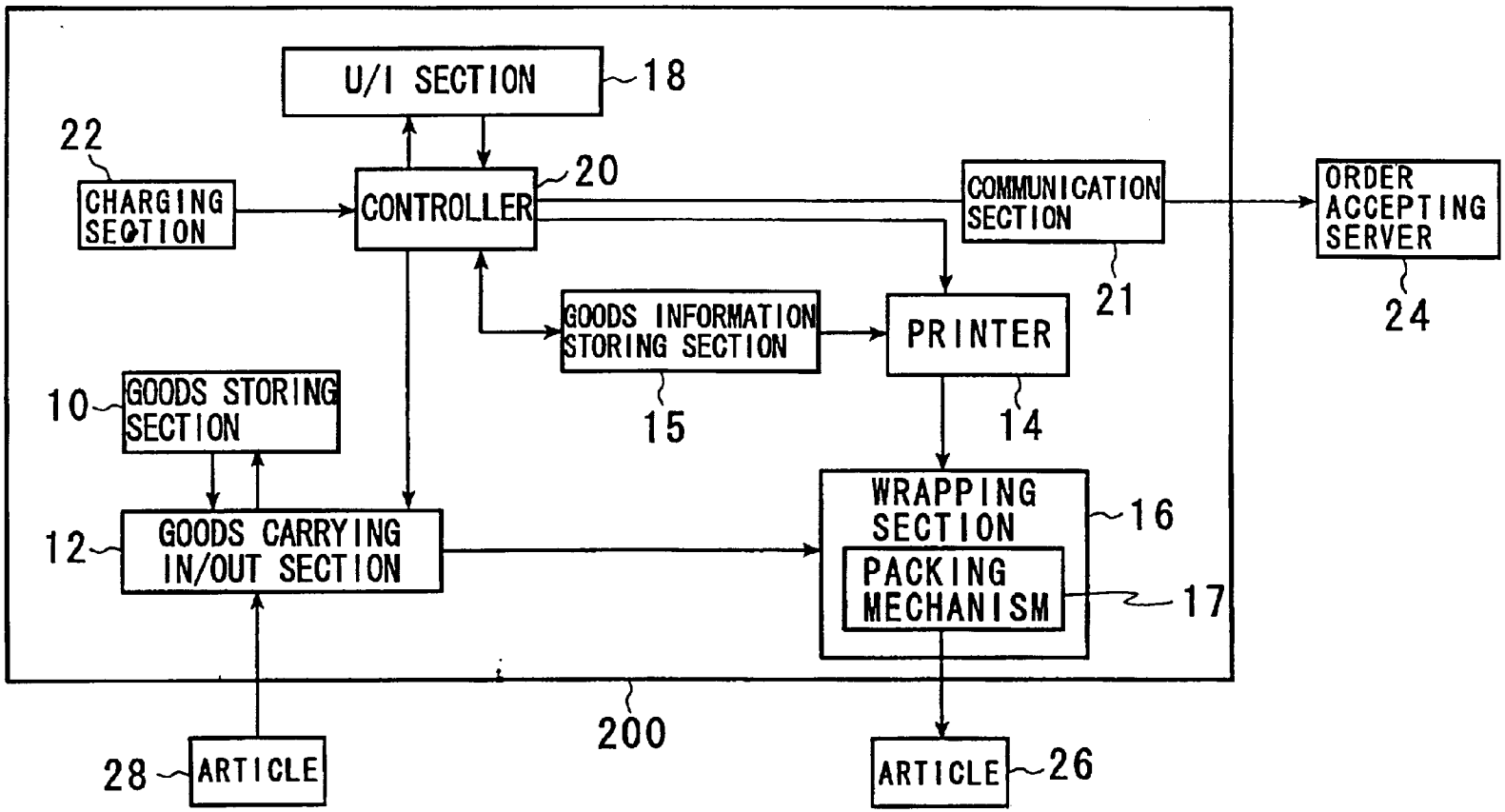
FIG. 1 is a diagram showing functional blocks of a goods-wrapping apparatus according to an embodiment of the present invention.

FIG. 1 shows a goods-wrapping apparatus 200, an order accepting server 24, an article 26 purchased by a user and an article 28 carried into the goods-wrapping apparatus 200 for replenishment. The goods-wrapping apparatus 200 includes a goods storing section 10, a goods carrying in/out section 12, a printer 14, a goods information storing section 15, a wrapping section 16, a user interface (U/I) section 18, a controller 20, a communication section 21, and a charging section 22. The wrapping section 16 has a packing mechanism 17 therein. The goods storing section 10 stores articles therein. For example, the goods storing section 10 may store the articles on trays provided for the respective articles. The goods carrying in/out section 12 carries out from the goods storing section 10 an article based on information from the controller 22 for specifying the article to be carried. The goods carrying in/out section 12 may be a robot that can pick out the article placed on the tray.

The charging section 22 includes an insertion means into which the user inserts money and a charging means that counts the inserted money and outputs charging information indicating the amount of money counted to the controller 20. In a case where the user inserts money to the amount of 5,000 yen, for example, the charging information indicating that the user paid 5,000 yen is output to the controller 20. The charging section 22 may include other charging means that can handle a credit card, electronic money, or some form of available payment other than cash.

The U/I section 18 includes a device used for communication of information between the user and the goods-wrapping apparatus 200, such as a display like a monitor, an output device like a printer, an input device like a keyboard, and a touch panel or a mouse. Moreover, the U/I section 18 may include a means operable to perform data inputting and/or outputting for a storage medium such as an optical storage medium like a CD-ROM, CD-R, CD-RW, DVD or DVD-RAM, a magneto-optical storage medium like an MO, a magnetic storage medium like a floppy disk, a semiconductor storage medium like a memory card or a non-volatile memory, or a means operable to perform data inputting and/or outputting via a communication circuit such as a telephone line or a network line. The goods-wrapping apparatus 200 can communicate with the user by means of the above-mentioned input/output device provided as the U/I section 18. For example, the goods-wrapping apparatus 200 can present a display image for allowing the user to select an article to be purchased, so that the user can select the desired article via the touch panel. In addition, information regarding the goods can be stored in an external storage medium such as a memory card.

The goods information storing section 15 stores information regarding the goods stored in the goods storing section 10. The information regarding the goods, for example, includes a price of each article, the number of goods in stock, the name of the maker, the logo image of the maker, and the content such as an image or character(s) associated with each article.

The controller 20 outputs a message or the information to the user regarding the goods based on the goods information stored in the goods information storing section 15. Moreover, the controller 20 inputs the user's instruction from the U/I section 18. For example, the controller 20 makes the U/I section 18 present the goods-selection display image for allowing the user to select a desired article and then obtains information regarding the article specified by the user from the U/I section 18. The controller 20 outputs information specifying the article selected by the user to the goods carrying in/out section 12 and the printer 14 in accordance with the user's instruction sent from the U/I section 18. In addition, for each of the articles, the controller 20 can output information indicating that said article is out of stock to the order-accepting server 24 via the communication section 21 based on the information regarding the number of goods in stock stored in the goods information storing section 15. For example, the controller 20 can output the information indicating that said article is out of stock to the order accepting server 24 via the communication section 21 at a time when said article is actually out of stock or at a time when the number of goods in stock of said article reaches a predetermined number.

The communication section 21 includes a means operable to be connected via the communication circuit to an external device such as the order accepting server 24, a contents server (not shown) that stores the printing contents, or a goods information server (not shown) that stores the goods information. The communication section 21, for example, includes a means operable to be connected to the external device such as the order accepting server 24, the contents server, the goods information server via either a public line like an analog-telephone line or an ISDN line, or a private line. Also, the communication section 21 may receive/transmit information while being directly connected to the order-accepting server 24 or while being connected to the external device such as the order accepting server 24 on the web via the Internet. For example, in the case of receiving/transmitting the information via the Internet, it is preferable that the communication section 21 encrypts the information to be transmitted and outputs the encrypted information to the external device such as the order accepting server 24. In addition, the communication section 21 can download a new printing content that is not stored in the goods-wrapping apparatus 200 from the external contents server or information regarding a new product from the external goods information server.

The order accepting server 24 includes a means operable to deliver an article to the goods-wrapping apparatus 200. For example, the order accepting server 24 makes the out of stock article be delivered to the goods-wrapping apparatus 200 in accordance with the information indicating that the article is out of stock, the information being sent from the controller 20 via the communication section 21. In the case where the order accepting server 24 is an on-line order accepting server provided on the web, the communication section 21 outputs article data regarding the article that is out of stock to the order accepting server 24 via the Internet. The order-accepting server 24 then transmits the article data to, for example, a delivery center computer that is to deliver the article. The delivery center computer makes the requested article be delivered to the goods-wrapping apparatus 200. The article 28 delivered to the goods-wrapping apparatus 200 is carried into the goods storing section 10 via the goods carrying in/out section 12. When the article is carried in, information regarding the number of goods in stock, that is stored in the goods information storing section 15, is updated. Thus, the information of the number of goods in stock is always updated. In an alternative embodiment, the controller 20 may update the information of the number of goods in stock stored in the goods information storing section 15 based on the articles stored in the goods storing section 10.

The printer 14 prints a printing content onto a bag used for wrapping the purchased article, and outputs the printed bag to the wrapping section 16. As the bag, a paper bag or a fabric bag having an opening and a closed portion opposite to the opening can be used, for example. The wrapping section 16 wraps the article supplied from the goods carrying in/out section 12 with the bag supplied from the printer 14 so as to output the article 26. Thus, the goods-wrapping apparatus 200 can wrap the article selected by the user with the bag onto which the printing content associated with the selected article is printed. Since the article is wrapped, it is possible to prevent the article from being stained while the article is being carried. In addition, after the user selects a certain article, the printer 14 prints the printing content associated with the selected article. Thus, it is enough for the printer 14 to store only one type of bag even in a case where the goods storing section 10 stores products of a plurality of makers. Accordingly, a space for storing the bags can be used efficiently.

Figure 2:
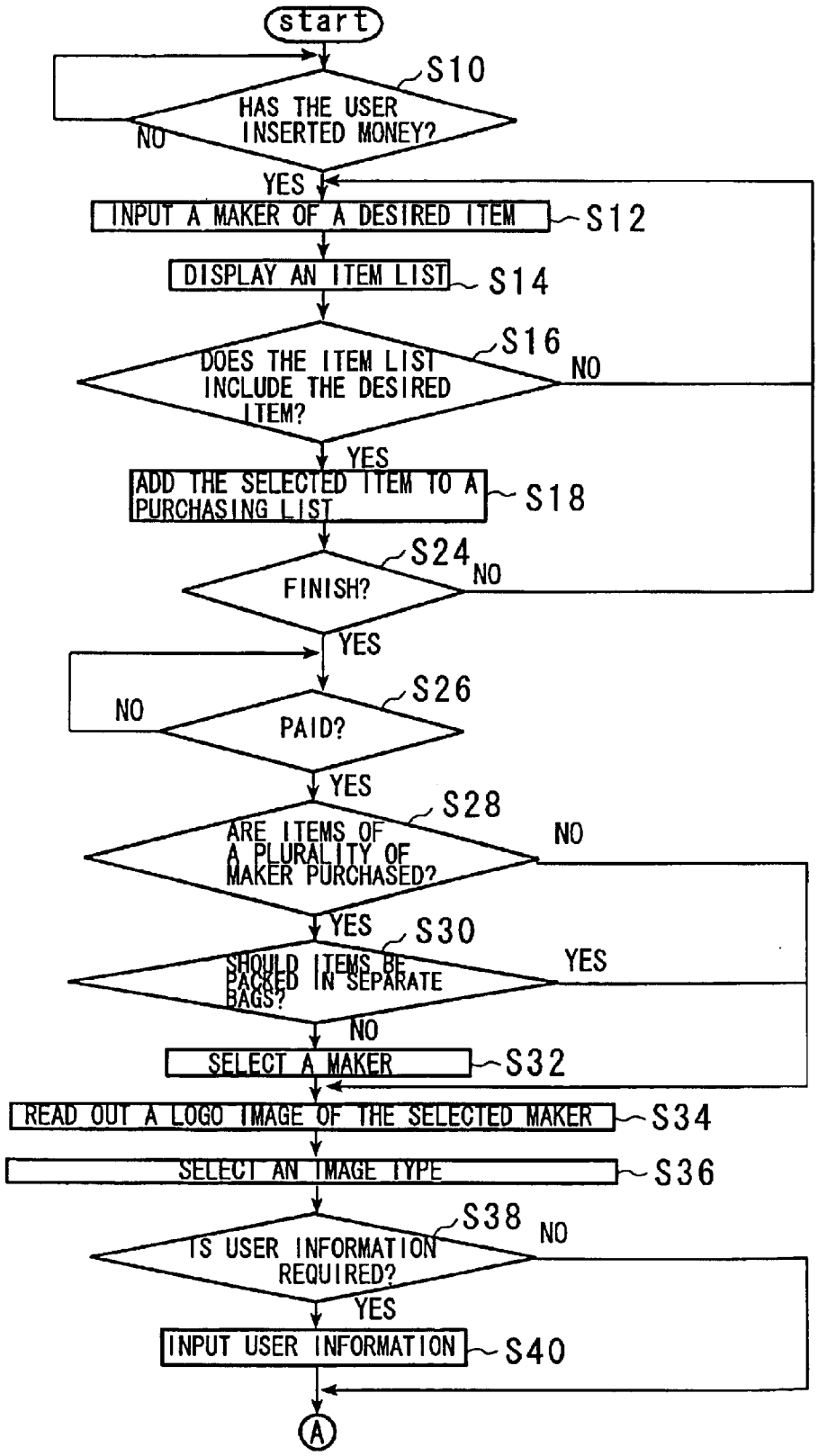
FIG. 2 is a flowchart of an operation of the goods-wrapping apparatus of FIG. 1.
Figure 3:
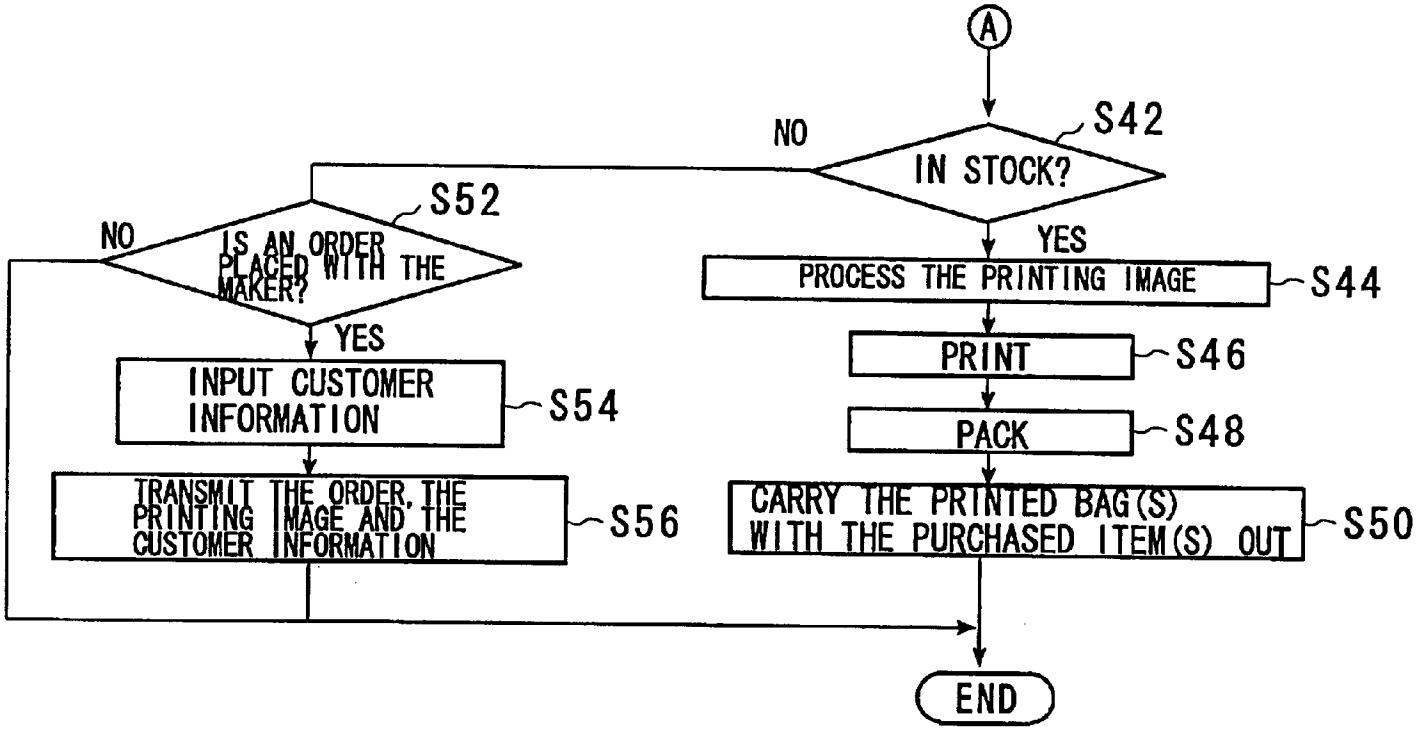
FIG. 3 is a flowchart of the operation of the goods-wrapping apparatus of FIG. 1, following the operation shown in FIG. 2.

FIGS. 2 and 3 are flowcharts of an operation of the goods-wrapping apparatus 200. The flow shown in FIG. 2 is followed by the flow shown in FIG. 3 at a point A. Referring to FIGS. 2 and 3, the flow of the operation of the goods-wrapping apparatus 200 is described. The controller 20 makes a display, provided in the U/I section 18, present a display image for asking the user for using the goods-wrapping apparatus 200. When the user specifies that the user uses the goods-wrapping apparatus 200 via the U/I section 18, the controller 20 then makes the display present a display image for requesting the user to insert the charge of using the goods-wrapping apparatus 200. The charging section 22 determines whether or not the charge is inserted or not (Step S10) and notifies the controller 20 the determination result. When the charge is inserted, the operation goes to a next step. The controller 20 makes the display of the U/I section 18 present a display image for allowing the user to select a maker of a desired article based on the goods information stored in the goods information storing section 15. The user selects one of the maker(s) presented on the display of the U/I section 18 (Step S12). For example, in a case where the goods information storing section 15 stores information regarding 30 makers, the user selects one of the 30 makers that manufactures the article the user wishes to purchase. Please note that the user can select only one maker of two or more makers.

The controller 20 makes the U/I section 18 present an item list of the selected maker (Step S14). The user then selects the desired item from the items presented on the display (Step S16). The controller 20 temporarily stores the item selected by the user in a selected item list (Step S18). When the user specifies that there is no item that the user wishes to purchase in Step S16, the flow goes back to Step S12. Then, the user is requested to select whether or not the user has finished the selection of articles (Step S24). In a case where the selection is finished, the controller 20 makes the U/I section 18 present the total purchase amount of money of the article(s). Then, the controller 20 determines whether or not the user has paid (Step S26).

When it is determined that the user has paid, a procedure for printing the printing content associated with the selected article onto a bag begins. First, the controller 20 determines whether the user selects the article(s) of a plurality of makers or a single maker based on the selected item list referred to in the description of Step S18 (Step S28). If the user selects the article(s) of the plurality of makers, the controller 20 makes the U/I section 18 present a display image for requesting the user to select whether or not the user wishes to wrap the articles with separate bags (Step S30).

When the user specifies that the user wishes to wrap the articles with the same bag, the controller 20 makes the U/I section 18 present a display image for requesting the user to select a maker's logo mark from logo marks of the plurality of makers (Step S32). The printer 14 then reads out the logo mark selected by the user in Step S32 from the goods information storing section 15 (Step S34). Also, if it is determined that the user selects the article(s) of a single maker in Step S28, the information of the logo mark of this maker is read out from the goods information storing section 15 (Step S34). In a case where the selected maker has a plurality of printing contents associated with the selected article, the controller 20 makes the U/I section 18 present a display image for requesting the user to specify which one of the printing contents is to be printed (Step S36). For example, in a case of using the user's name and the logo mark of the maker as the printing content, the controller 20 makes the U/I section 18 present a display image for requesting the user to input the user's name.

Then, it is determined whether or not the printing content selected by the user in Step S36 requires user information such as the name and the sex of the user (Step S38). If the user information is required, the controller 20 inputs the user's name sent from the input device of the U/I section 18 (Step S40). The controller 20 then performs a stock confirmation by determining whether or not the article selected by the user is stored in the goods storing section 10 based on the article information stored in the U/I section 18 (Step S42). In a case where the selected article is in stock, the printer 14 conducts a predetermined operation so as to print the printing content onto a bag (Step S44). The predetermined operation may be an operation for adjusting the size of the logo mark in accordance with the size of the bag, for example. Moreover, the printing content to be printed onto the bag may be freely created by the user by means of the input device provided in the U/I section 18, such as the touch panel, the mouse, or the keyboard. The printer 14 then prints the printing content adjusted or created in Step S44 onto the bag (Step S46). The packing mechanism 17 of the wrapping section 16 wraps the article supplied from the goods carrying in/out section 12 with the bag having the printing content associated with the article that is supplied from the printer 14 (Step S48). The wrapping section 16 carries out the wrapped article to the user (Step S50).

In the stock confirmation in Step S42, if the article selected by the user is out of stock, the controller 20 makes the U/I section 18 present a display image for requesting the user to select whether or not the order of the selected article is placed with the maker (Step S52). In a case of placing the order, the controller 20 makes the U/I section 18 present a display image for requesting the user to input customer information that is related to the user, such as the name, the address, the telephone number or the like, and the printing content that the user wishes to print when the selected article is wrapped (Step S54). The controller 20 then outputs the customer information input in Step S54 to the order accepting server 24 (Step S56). The order accepting server 24 performs a necessary operation for delivering the article to the user based on the customer information supplied from the controller 20. Thus, even if the article selected by the user is out of stock, the user can obtain the desired article. When the user specifies that the user does not wish to place the order of the article in Step S52, the operation ends.

Therefore, the user can purchase the desired article from the goods-wrapping apparatus 200. In addition, since the purchased article is wrapped with the bag onto which the printing content associated with the article is printed, the package of the article can be prevented from being stained. Moreover, since the logo mark of the maker is printed onto the bag, the user can feel the same degree of satisfaction as if the user buys the article in the shop. Also, the printing content to be printed on the bag can be freely processed by the user. Thus, a special bag for the user can be created. Furthermore, the logo image of the maker or the like is printed onto the bag for every purchase of the article by the user. Thus, even if the goods-wrapping apparatus 200 deals with articles of various makers, only one type of bag is necessary for wrapping the articles, and it is therefore efficient.

Figure 4:
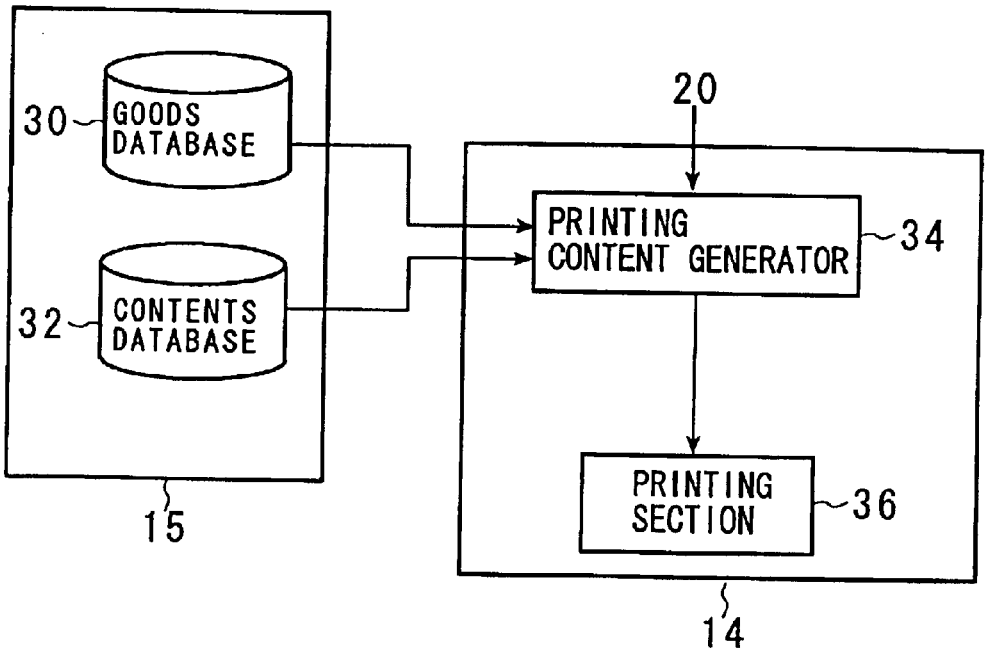
FIG. 4 is a diagram showing functional blocks of a goods information storing section 15 and a printer 14.

FIG. 4 shows the goods information storing section 15 and the printer 14. The goods information storing section 15 includes a goods database 30 that stores the goods information and a contents database 32 that stores the printing contents such as image information and/or character information associated with each article. The printer 14 includes a printing content generator 34 and a printing section 36. The printing content generator 34 reads content from the contents database 32 based on information that specifies the article selected by the user sent from the controller 20 and the goods information stored in the goods database 30, so as to generate the printing content to be printed onto the bag. The printing content generator 34 outputs the generated printing content to the printing section 36 that prints the printing content onto the bag. Thus, the printing content associated with the article selected by the user can be printed on the bag.

FIG. 5 shows an example of the goods information stored in the goods database 30. For example, the goods database 30 stores information of the item number, the item name, the maker name of the item, the price, the number of goods in stock, and the content(s) for each article. The item number is, for example, a management number that is uniquely assigned to each article stored in the goods storing section 10. The item name is a classification of article, such as a camera, a sweater, or trousers. Alternatively, the item name may be a trade name of the article. The maker name of the item is the name of the maker that manufactured the article. The price is a unit price of the article. The number of goods in stock is the number of stocks in the goods storing section 10. For example, the controller 20 can output the information specifying that there is no stock to the order-accepting server 24 based on the information of the number of goods in stock. The contents information is information specifying the content to be printed onto the bag used for wrapping the article.

FIG. 6 is an example of the information of printing contents stored in the contents database 32. The contents database 32 stores the printing contents such as the image information and/or the character information associated with the respective articles. For example, the contents database 32 stores the content number, the name of the maker, and the name of the file specifying the printing content, such as Content 1 or Content 2. The content number is uniquely assigned to the respective maker. The contents store the name of the content files. For example, the file specified in the contents stores the printing content information such as the image information and/or the character information. In a case where the item number is supplied from the controller 20, the printing content generator 34, described with reference to FIG. 4, reads the information of the maker and the contents from the goods database 30, and then reads out the file name of the printing content from the contents database 32 based on the information read from the goods database 30. Then, the printing content specified by the read file name is output to the printing section 36. In this way, the printing content associated with the article can be printed for the respective articles.

Figure 7:
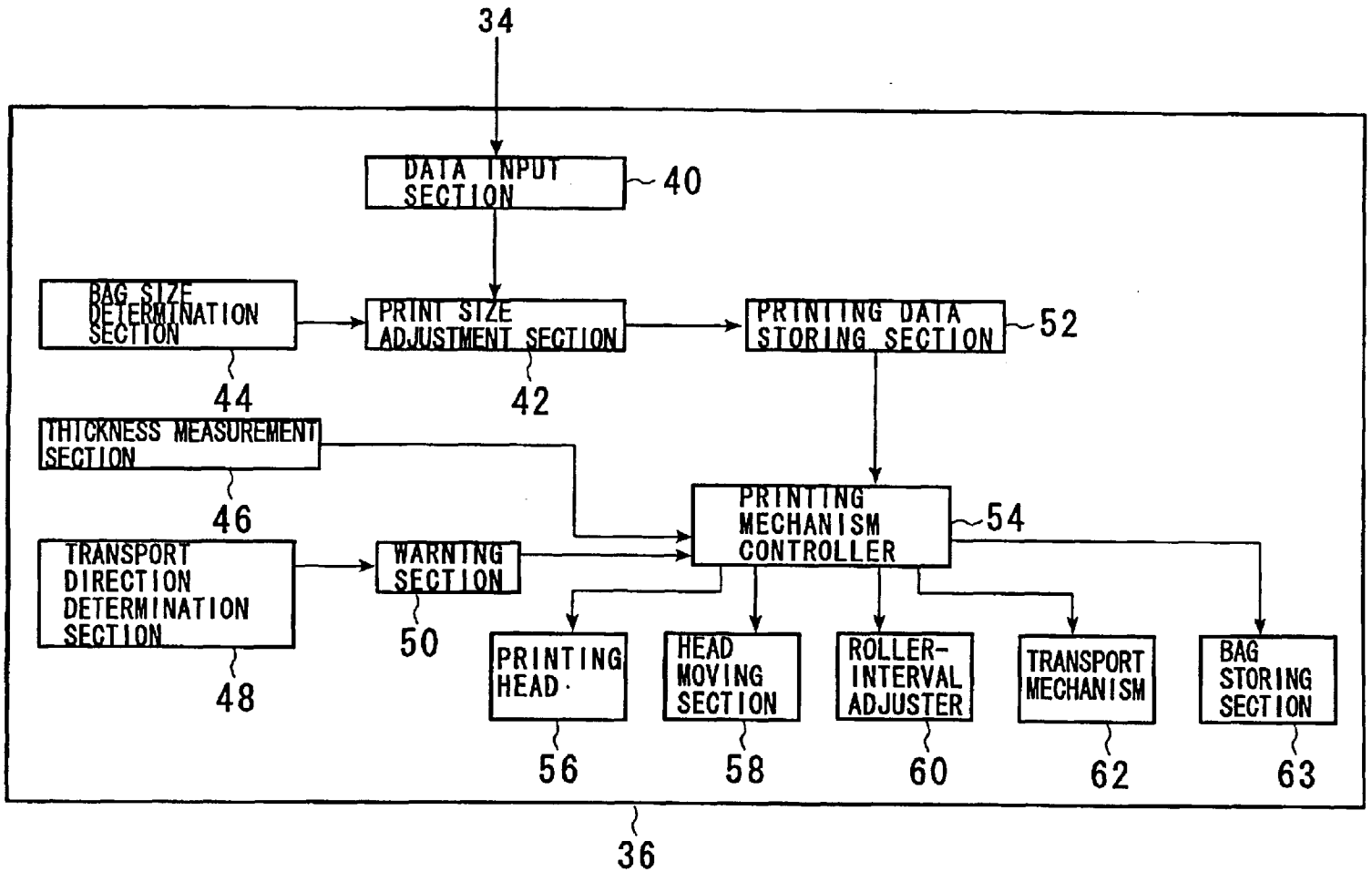
FIG. 7 is a diagram showing functional blocks of a printing section 36.

FIG. 7 shows exemplary functional blocks of the printing section 36. The printing section 36 includes a data input section 40, a print size adjustment section 42, a bag size determination section 44, a thickness measurement section 46, a transport direction determination section 48, a warning section 50, a printing data storing section 52, a printing mechanism controller 54, a printing head 56, ahead moving section 58, a roller-interval adjuster 60, a transport mechanism 62, and a bag storing section 63. The data input section 40 inputs the printing content from the printing content generator 34 and then outputs it to the print size adjustment section 42. The data input section 40 may be a buffer operable to temporarily store information supplied from the printing content generator 34, for example.

The bag size determination section 44 determines the size of the bag onto which the printing content is to be printed and outputs the determination result to the print size adjustment section 42. For example, the bag size determination section 44 may include a capturing device operable to capture an image of the bag, such as a CCD or a line sensor, and determine the size of the bag based on the size of the bag captured by the capturing device. In addition, a mark that is a bar code specifying the size of the bag may be provided with the bag. In this case, the bag size determination section 44 may determine the bag size based on the size information included in the bar code.

The print size adjustment section 42 adjusts the size of the printing content in such a manner that the printing content is able to be printed on the bag, based on the printing content supplied from the data input section 40 and the size of the bag supplied from the bag size determination section 44. The print size adjustment section 42 outputs the printing content that has been subjected to the size adjustment to the printing data storing section 52. Since the print size adjustment section 42 adjusts the size of the printing content based on the bag size, it is not necessary for the contents database 32 to store a file of a printing content for each of the bags that have different sizes. Thus, the amount of data stored in the contents database 32 can be reduced. Also, the data can be easily managed. In a case where the printing content supplied from the data input section 40 is large with respect to the bag size, for example, the print size adjustment section 42 reduces the size of the printing content. The printing data storing section 52 then outputs the printing content having the size adjusted depending on the bag size to the printing mechanism controller 54.

The thickness measurement section 46 measures the thickness of the bag and outputs the measured thickness to the printing mechanism controller 54. The thickness measurement section 46 measures the thickness of the cross section of the bag. In a case of a bag that is folded at the bottom thereof, for example, the thickness of the bag becomes large at the folded portion; becomes small at the center of the bag; and becomes large at the handle thereof. The thickness measurement section 46 measures the thickness of the bag and outputs the measurement result to the printing mechanism controller 54.

The transport direction determination section 48 detects the transport direction of the bag and outputs the detection result to the warning section 50. In a case of transporting a bag having an opening and a closed portion opposite to the opening, it is preferable to transport the bag in a direction in which the closed portion goes at the head of the bag. Such a direction is detected by the transport direction determination section 48. The transport determination section 48 may detect a predetermined mark provided on the bag and determine whether or not the bag is transported in the direction in which the closed portion goes at the head of the bag based on the detection result. For example, the transport direction determination section 48 may include a capturing device such as a CCD or a line sensor and detect the mark provided on the bag based on an image of the bag captured by the capturing device. In this case, the mark may be a bar code and the transport direction determination section 48 may be a bar code reader.

The warning section 50 outputs warning information to the printing mechanism controller 54 when the bag is not transported in the direction in which the closed portion goes in advance of the opening. The printing mechanism controller 54 controls the printing head 56, the head moving section 58, the roller-interval adjuster 60 and the transport mechanism 62 based on the printing content supplied from the printing data storing section 52, the thickness information of the bag sent from the thickness measurement section 46 and the warning information sent from the warning section 50, so as to print the printing content onto the bag.

The printing mechanism controller 54 controls the head moving section 58 and the roller-interval adjuster 60 based on the thickness information of the bag sent from the thickness measurement section 46. In a case where the bag has a thickness such that the bag comes into contact with the printing head 56, the head moving section 58 moves the printing head 56 to an escape position at which the printing head 56 cannot be in contact with the bag. By moving the printing head 56 to the escape position, the stain that may be caused by the contact of the head with the bag can be prevented in a case of using a printing technology in which the printing head 56 jets ink to a printing medium, such as ink-jet printing or solid-jet printing. Also, in a case of using a printing technology in which the printing head 56 is brought into contact with the printing medium to perform the printing, such as thermal ink transfer printing, thermal printing, dye sublimation printing, thermo-auto chrome printing or the like, it is possible to protect the printing head from a load caused by being pressed by the load of larger than necessary magnitude. Moreover, the bag can be protected from damage or stain caused by the contact between the bag and the printing head.

The roller-interval adjuster 60 adjusts an interval between two rollers included in the transport mechanism 62 that transports the bags by means of the two rollers opposite to each other. Since the roller interval is changeable, it is possible to transport the bag while the transport mechanism 62 holds the bag with a constant force irrespective of the bag's thickness. The bag storing section 63 stores bags. For example, the bag storing section 63 may be a tray on which a plurality of bags are placed and carry out the bags on the tray individually to the transport mechanism 62. In addition, the bag storing section 63 may store a plurality of bags for each different sized bag. Moreover, the bag storing section 63 may pick up one bag and carry it out to the transport mechanism 62. The transport mechanism 62 transports the bags stored in the bag storing section 62 individually.

The printing head 56 prints the printing content onto the bag. For example, the printing head 56 may perform the printing in accordance with any printing technology, such as ink-jet printing, solid-jet printing, thermal ink transfer printing, thermal printing, dye sublimation printing, thermo-autochrome printing or laser printing. In a case of thermal printing or thermo-autochrome printing, a heat-sensitive layer is provided with the bag. In addition, in a case of thermo-autochrome printing, light rays for fixing are provided. The printing head 56 can overcoat the printing content after printing the printing content onto the bag. The overcoat on the bag can prevent the printing content from smudging even if the bag gets wet because of rain or the like. Also, it is possible to make the bag difficult to be torn even when the bag gets wet.

Figure 8:
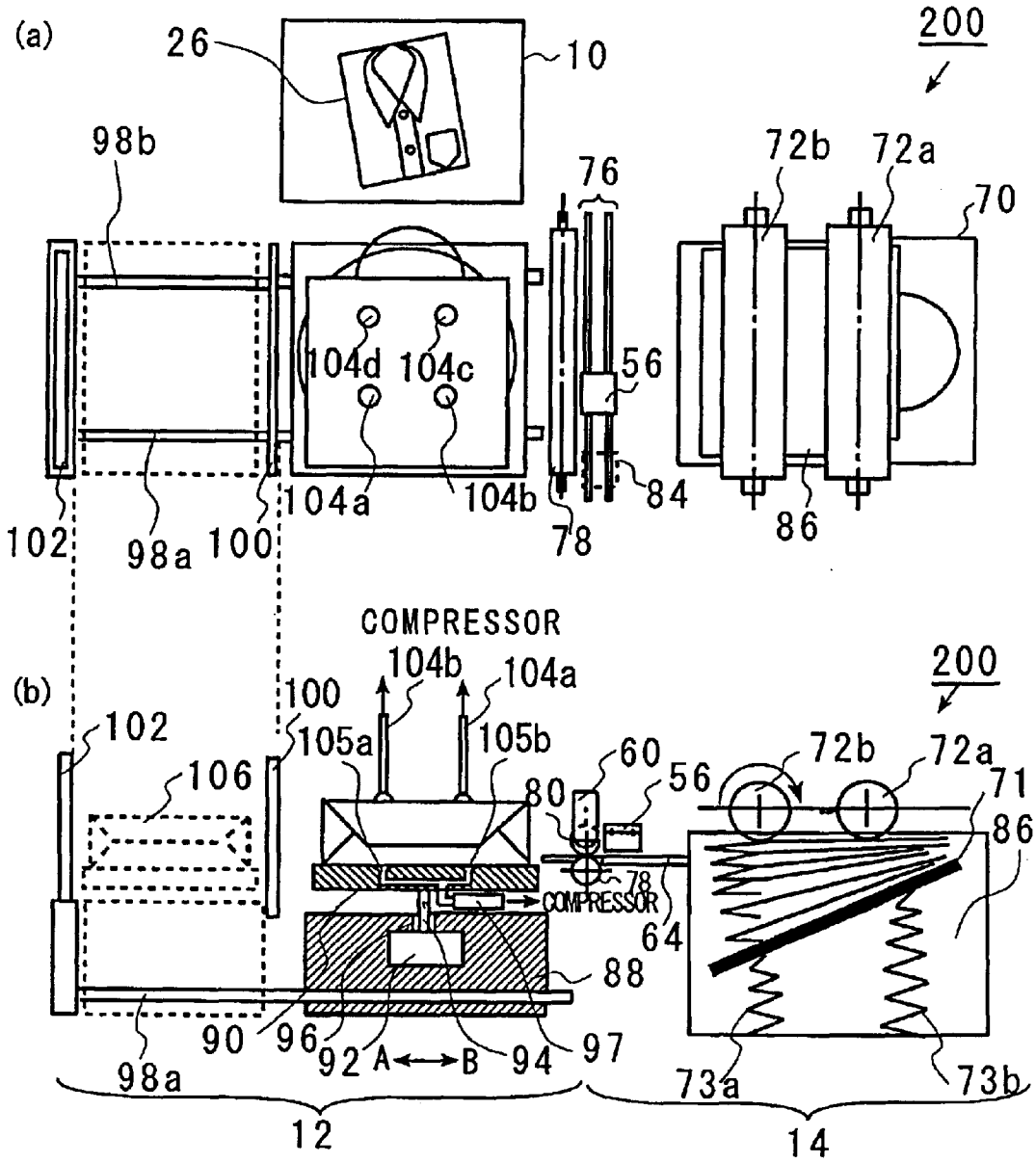
FIG. 8 shows an exemplary configuration of the goods-wrapping apparatus 200.

FIGS. 8(*a*) and 8(*b*) are a front view and a side view showing a mechanical configuration of the goods-wrapping apparatus 200, respectively. The printer 14 includes a bag storing section 70, a head moving guide 76, a transport surface 64, the printing head 56, a capstan roller 78, a pinch roller 80, and the roller-interval adjuster 60. The bag storing section 70 includes sending rollers 72*a* and 72*b*, a base plate 71, and springs 73*a* and 73*b*. The goods carrying in/out section 12 includes a pedestal 88 movable along guides 98*a* and 98*b*, a rotation table 90 fixed to the pedestal 88, suction valves 104*a*, 104*b*, 104*c* and 104*d* connected to a compressor (not shown), and shutters 100 and 102. Thus, the suction valves 104*a*, 104*b*, 104*c* and 104*d* can attract the bag 86 by a suction force.

The pedestal 88 includes a motor 92 therein and is connected to the center of the rotation of the rotation table 90 via a rotation axis 94 supported by a bearing 96. The rotation table 90 has a suction opening on its surface and is connected to the compressor (not shown) via a conduit provided in the rotation table 90 and a hose 97. Thus, the rotation table 90 can attract the bag 86 to the surface of the rotation table 90. The shutters 100 and 102 are closed until the article is carried out. It is preferable that the hose 97 has a space for allowing the rotation table 90 to rotate by at least 90 degrees.

The bag storing section 70 accommodates the bag 86. The bag 86 is placed on the upper surface of the base plate 71. The base plate 71 is urged towards the sending rollers 72*a* and 72*b* by the springs 73*a* and 73*b*. Thus, the bag 86 is pushed onto the sending rollers 72*a* and 72*b* and therefore is sent towards the printing head 57 by the rotation of the sending rollers 72*a* and 72*b*. It is preferable that the sending roller 72*a* has a diameter of 10 mm or more, for example, because the bag 86 has a step between the folded portion and the unfolded portion. In addition, the bag 86 is preferably stored in the bag storing section 70 in such a manner that the closed portion of the bag 86 faces the printing head 56. Moreover, it is preferable that the sending rollers 72*a* and 72*b* are arranged in such a manner that a plane is obtained by connecting a portion of the contact of the sending roller 72*a* and the bag 86 to a portion of the contact of the sending roller 72*b* and the bag 86 and the transport surface 64 are positioned horizontally.

The printing head 56 can move along the head moving guide 76 in a direction perpendicular to the transport direction of the bag 86. As for the folded portion at the bottom of the bag 86 and the handle thereof, the printing head 56 moves to the escape position 84. In an alternative embodiment, the printing head 56 may escape upwards with respect to the surface of the bag 86. The capstan roller 78 and the pinch roller 80 rotate while putting the bag 86 therebetween, thereby transporting the bag 86. Since the bag 86 has the step as mentioned above, the diameters of the capstan roller 78 and the pinch roller 80 are preferably 10 mm or more, for example. The roller-interval adjuster 60 moves the center of the rotation of the capstan roller 78 depending on the thickness of the bag 86, thereby adjusting the interval between the capstan roller 78 and the pinch roller 80. In addition, it is preferable that the capstan roller 78 and the pinch roller 80 press the bag 86 with a force of 0.4 kgf/cm or more, for example. The bag 86 onto which the printing content has been printed by the printing head 56 is transported in such a manner that the closed portion leads the bag 86. Thus, the bag 86 is placed on the surface of the rotation table 90 so as to make the closed portion face towards a direction A. Moreover, since the bottom of the bag 86 passes through the printing head 56 first, it is preferable that the printing mechanism controller 54 controls the printing head 56 to start the printing operation from a portion to be positioned at the bottom of the bag 86 when the whole printing content is printed onto the bag 86.

When the bag 86 is placed on the surface of the rotation table 90, the rotation table 90 rotates to make the opening of the bag 86 face the goods storing section 10. In a case where the goods storing section 10 is arranged beside the pedestal 88, the rotation table 90 rotates by approximately 90 degrees. When the opening of the bag 86 faces the goods storing section 10, the compressor (not shown) operates to attract the bag 86 to the surface of the rotation table 90. Also, the suction valves 104*a*, 104*b*, 104*c* and 104*d* go down until the suction valves 104*a*, 104*b*, 104*c* and 104*d* come into contact with the bag 80 placed on the surface of the rotation table 90. Since the compressor has already started to operate, the bag 86 is attracted by the suction valves 104*a*, 104*b*, 104*c* and 104*d*. The suction valves 104*a*, 104*b*, 104*c* and 104*d* then go up, thereby the bag 86 is made to open. The goods carrying in/out section 12 carries the article 26 stored in the goods storing section 10 into the bag 86. For example, the goods carrying in/out section 12 may carry the article stored in the goods storing section 10 into the bag 86 by means of a robot (not shown).

When the article 26 is wrapped with the bag 86, the shutter 100 is opened and the pedestal 88 moves to a goods carrying out position 106. When the pedestal 88 reaches the goods carrying out position 106, the shutter 100 is made to close again. When the shutter 100 is made to close, the shutter 102 is made to open, thereby the user can pick up the article 26 wrapped with the bag onto which the printing content associated with the article 26 is printed. Since the shutter 100 is closed when the shutter 102 is made to open, the user cannot insert his/her hand into the goods-wrapping apparatus 200. Therefore, it is possible to prevent the user from being hurt by inserting his/her hand into the goods-wrapping apparatus 200. Also, it is possible to prevent mischief by the user.

Figure 9:
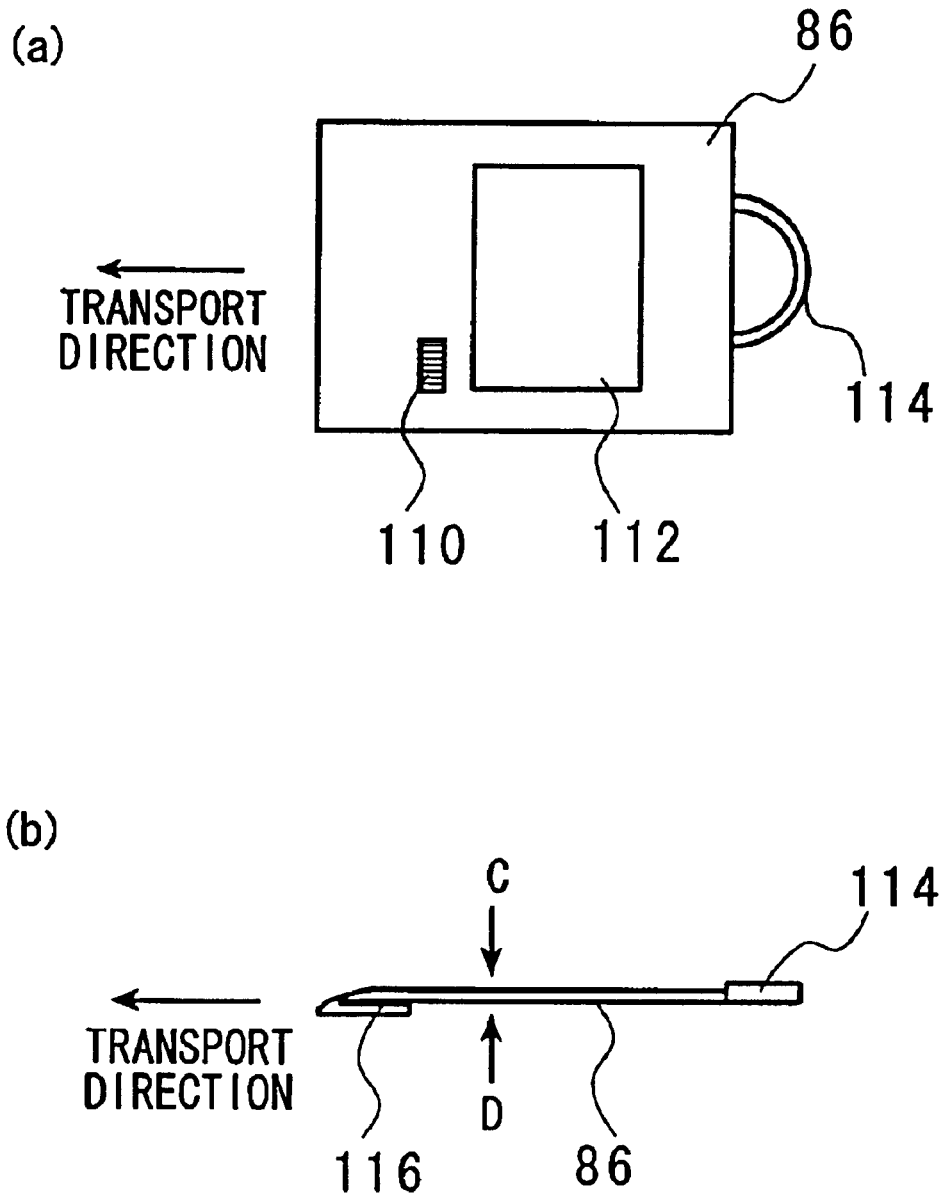
FIG. 9 shows a bag 86.

FIG. 9(*a*) is a front view of the bag 86. The bag 86 includes an ink receptor layer 112 within which the printing content can be printed, the mark 110 for making the printing section 36 print the printing content, and the handle 114. The ink receptor layer 112 corresponds to a region in which the printing head 56 can perform the printing. The ink receptor layer 112, for example, is a region of the bag 86 having no waterproof coating that uses a transparent ink or the like. When the ink receptor layer 112 is partially provided, the cost for the bag 86 can be reduced as compared with the case where the whole bag 86 is formed from the ink receptor layer 112. It is preferable that the ink receptor layer 112 has a higher absorption ability to the ink and is more difficult to blur, as compared with the other portion. It should be noted that the ink receptor layer 112 may be a thermal recording layer onto which the thermal type printing head 56 can perform the printing or a thermal recording layer onto which the thermo-autochrome type printing head 56 can perform the printing.

The ink receptor layer 112 is preferably a layer corresponding to the printing method of the printer 14. In a case of the ink jet printing, for example, the ink receptor layer 112 for the ink jet printing is provided. In a case of the thermal printing or the thermo-autochrome printing, a thermal coloring layer or a photo-fixing type thermal coloring layer is provided as the ink receptor layer 112. In a case of the thermal ink transfer printing or the dye sublimation printing, the ink receptor layer 112 allowing the ink to be transferred thermally or the ink receptor layer 112 allowing the ink to be transferred while being sublimated is provided. The mark 110 is the bar code, for example. By detecting the mark 110, the transport direction determination section 48 determines the transport direction of the bag 86. The mark 110 may include information specifying the region within which the printing can be performed. In this case, the printing section 36 may move the printing head 56 to the escape position based on the region specified by the information included in the mark 110. Furthermore, the mark 110 may include information regarding the Size of the bag 86. In this case, the bag size determination section 44 may detect the information regarding the size of the bag 86.

FIG. 9(*b*) is a side view of the bag 86. In a case where the bag 86 is folded at the bottom thereof, it is preferable to transport the bag 86 in such a manner that the folded portion 116 goes at the head of the bag 86. Such transport reduces the possibility that the bag 86 is obstructed by the component existing in the transport path, such as the printing head 56, while the bag 86 is being transported. In addition, it is preferable that the ink receptor layer 112 is provided on a surface opposite to the folded portion 116 of the bag 86. Referring to FIG. 9(*b*), in a case where the ink receptor layer 112 is provided on the side C of the bag 86, it is preferable to print the printing content onto the surface on the side C of the bag 86. Moreover, the bag 86 is preferably transported in the posture in which the folded portion 116 leads the bag 86. Furthermore, it is preferable that the folded portion 116 faces towards the opposite direction to the printing head 56.

Accordingly, the apparatus that wraps the article with the bag onto which the printing content associated with the article to be wrapped is printed can be provided. Since the article is wrapped, the package of the article can be prevented from being stained. In addition, since the printing content is printed onto the bag for every article the user selected, it is not necessary for the goods-wrapping apparatus 200 to store a bag unique to each maker.

Although the present invention has been described by way of exemplary embodiments, it should be understood that many changes and substitutions may be made by those skilled in the art without departing from the spirit and the scope of the present invention which is defined only by the appended claims. The modified examples are described below.

In the first modified example, the printing content generator 34 may print the user's desired image(s) or character (s) onto the bag. In a case where the user wishes to print an image stored in a storage medium such as a memory card, for example, the controller 20 reads out the user's desired image via a memory card reader provided in the U/I section 18 and outputs the read image to the printing content generator 34. In addition, an image drawn by the user with a touch panel or a mouse provided in the U/I section 18 may be printed as the printing content onto the bag. Also, the U/I section 18 may include a capturing device operable to capture an image of the user, and the captured image of the user may be printed onto the bag. Moreover, the date, time of the purchase, or the address of the place of the purchase may be printed onto the bag. Furthermore, the printing content that is selected from the contents stored in the contents database 32 and is actually printed onto the bag may be changed depending on the time of the purchase, such as the season or month of the purchase.

In the second modified example, the thickness measurement section 46, the printing head 56, and the head moving section 58, that were described with reference to FIG. 7, may move the printing head 56 mechanically depending on the thickness of the printing medium.

Figure 10:
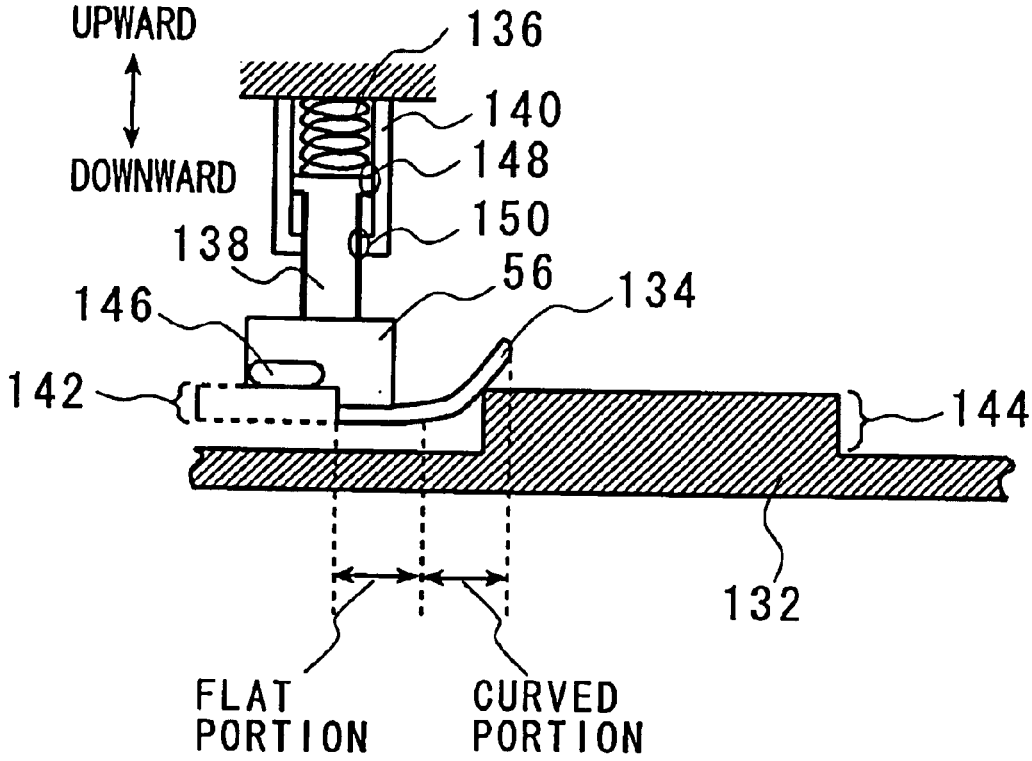
FIG. 10 shows an exemplary configuration of a head moving section 58.

FIG. 10 shows another embodiment of the thickness measurement section 46, the printing head 56, and the head moving section 58 that were described with reference to FIG. 7. A thickness detector 134 includes a flat portion that comes in contact with a printing medium 132 horizontally and a curved portion that has a predetermined curvature. The printing head 56 is connected to the thickness detector 134. There is a predetermined interval between the flat portion of the thickness detector 134 and an ink jet nozzle 145 of the printing head 56. This interval is a head-printing surface interval 142 in FIG. 10. Preferably, the head-printing surface interval 142 is appropriately determined in advance so as to be equal to or less than the interval between the ink jet nozzle 146 and the surface of the recording medium 132.

A slide axis 138 is connected to the printing head 56 and is movable in an upward or downward direction along a slide bearing 140. The slide axis 138 includes a stopper 148 having a portion of the first diameter and a portion of the second diameter larger than the first diameter. The slide bearing 140 includes an insertion opening 150 for the slide axis that has a diameter larger than the first diameter and smaller than the second diameter of the slide axis 138. Thus, the slide axis 138 can slide down to such a position that the stopper 148 and the insertion opening 150 are brought into contact with each other. On the other hand, the slide axis 138 is connected to the printing head 56 at one end. In a space sandwiched between the other end of the slide axis 138 and the slide bearing 140, a spring 136 is provided. The spring 136 is in contact with the end of the slide axis 138 at one end thereof while being in contact with a body of the apparatus 200 at the other end. Thus, when the slide axis 138 moves upwards, the spring 136 generates an opposing force for moving the slide axis 138 downwards. Accordingly, the ink jet nozzle 146 can moved in such a manner that the thickness detector 134 is always in contact with the printing medium 132.

The printing medium 132 shown in FIG. 10 has a step 144. Assuming that the printing medium 132 moves from the right side to the left side in FIG. 10, the left end of the step 144 comes into contact with the curved portion of the thickness detector 134. The curved portion of the thickness detector 134 has the predetermined curvature, as described before. Thus, as the printing medium 132 moves from the right side to the left side in FIG. 10, the printing head 56 can move upwards. Therefore, the thickness detector 134 can detect the step 144 and moves the printing head 56. In addition, when the flat portion of the thickness detector 134 comes into contact with the printing medium 132, the head-recording surface interval 142 becomes a predetermined interval. Thus, the printing head 56 can perform the printing for recording media having different thicknesses.

In the third modified example, the printing head can be selected depending on the material of the bag. For example, a printing head using ink for both a fabric bag and a paper bag may be provided. In this case, it may be determined whether the bag is made of fabric or paper and then one of the printing heads may be selected in accordance with the determination result.

In the fourth modified example, a position of the bag 86 with respect to the transport direction thereof may be changed in a case where the bag 86 is not transported in such a manner that the closed portion goes at the head of the bag.

In the fifth modified example, the printing mechanism controller 54 may perform an operation for detecting the mark 110 provided on the bag 86 and printing the printing content onto the bag 86 when the mark 110 is detected.

Figure 11:
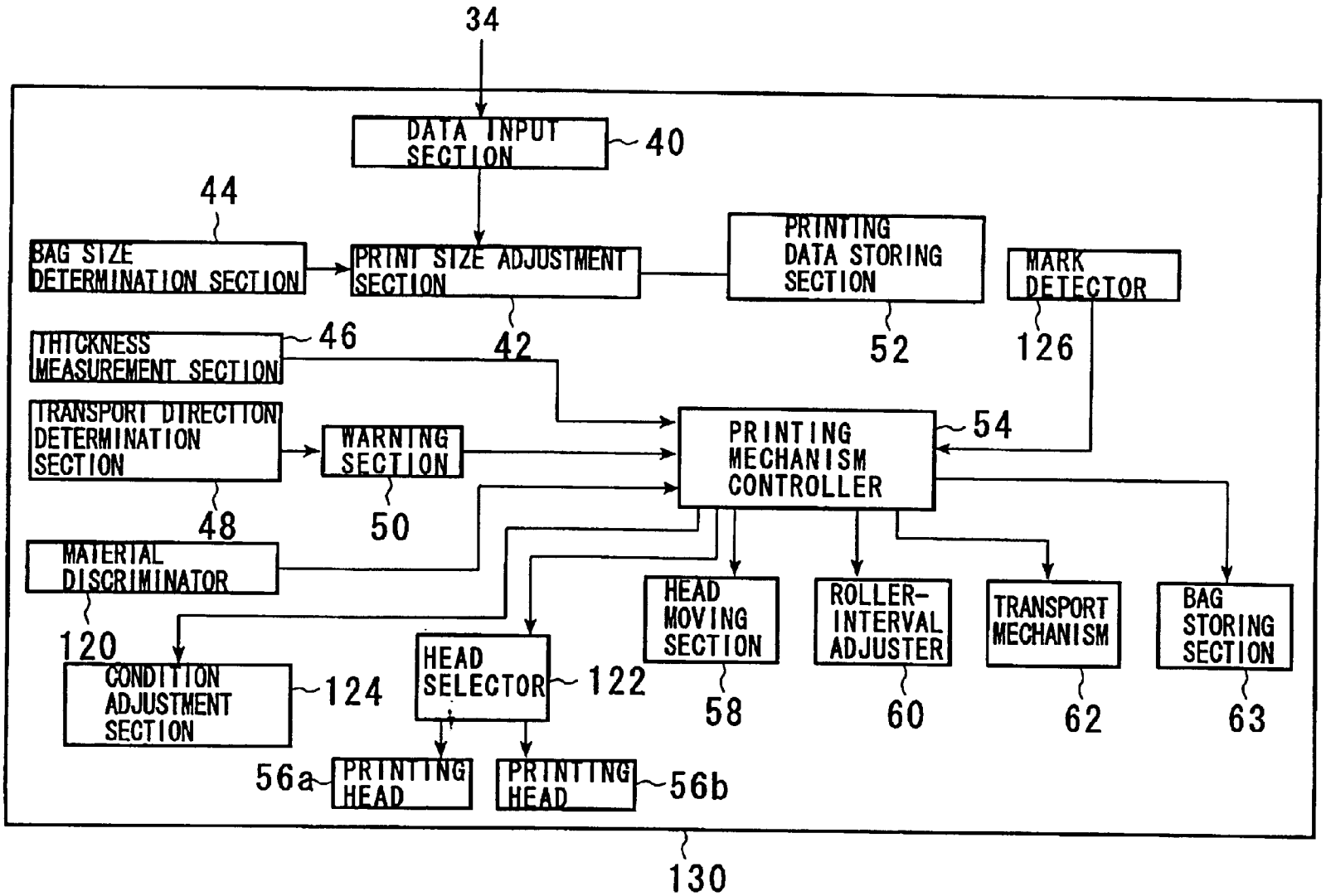
FIG. 11 is a diagram showing functional blocks of a printing section 130.

FIG. 11 is a diagram showing functional blocks of a printing section 130 according to the third, fourth and fifth modified examples. Components in FIG. 11 labeled with the same reference numerals as those in FIG. 7 operate in the same manner as the components in FIG. 7 and therefore the description thereof is omitted. The printing section 130 includes the arrangement corresponding to the printing section 36 in FIG. 7 and a material discriminator 120, a head selector 122, printing heads 56*a* and 56*b*, a condition adjustment section 124, and a mark detector 126.

The mark detector 126 detects the mark 110 provided on the bag 86. In a case where there is no mark on the bag 86, the mark detector 126 does not operate the printing mechanism controller 54 to perform the printing of the printing content. The mark 110 indicates that the bag 86 has a predetermined quality and the printing content can be printed under ideal conditions, for example. The logo mark of the maker to be printed on the bag 86 is precious for the maker. If the logo mark is blurred and is seen as a color different from the predetermined color of the logo mark in the printing of the logo mark, a corporate image of the maker may be degraded. In order to prevent this, the mark certifying the quality of the bag is provided on the bag.

The condition adjustment section 124 changes the position of the bag 86 with respect to the transport direction in a case where the bag 86 cannot be transported in the direction in which the closed portion of the bag 86 goes at the head of the bag 86, thereby changing the posture of the bag 86 with respect to the transport direction. For example, the condition adjustment section 124 changes the position of the bag 86 to such a position that the bag 86 is transported in the direction in which the closed portion of the bag 86 goes in advance of any other portion thereof and the surface of the bag 86 onto which the printing content is printed faces the printing head. Therefore, the posture of the bag 86 with respect to the transport direction is such a posture that the bag 86 can be transported in the direction in which the closed portion goes at the head of the bag and the ink receptor layer 112 faces the printing head 56. In a case where the bag 86 is stored in the bag storing section 63 while the handle 14 shown in FIG. 9 goes at the head of the bag 86, for example, the condition adjustment section 124 rotates the bag 86 to the position allowing the bag 86 to be transported in the direction in which the folded portion 116 goes at the head of the bag. Thus, the bag 86 can take the posture allowing the bag 86 to be transported in the direction in which the folded portion 116 goes at the head of the bag. Moreover, in a case where the ink receptor layer 112 does not face the printing head 56, the condition adjustment section 124 changes the posture of the bag 86 by reversing the bag 86 so as to make the ink receptor layer 112 face the printing head 56. It is preferable that the bag 86 is transported while holding the above-mentioned posture. The condition adjustment section 124 changes the posture of the bag 86 so that the bag 86 is in the posture described with reference to FIG. 9.

The material discriminator 120 discriminates the material for the bag 86. For example, the mark 110 may include information specifying the material for the bag 86. In this case, the material discriminator 120 may discriminate the material for the bag 86 by detecting the information of the bag material included in the mark 110. The material discriminator 120 outputs the bag material to the printing mechanism controller 54 that, in turn, outputs the information of the bag material to the head selector 122. The head selector 122 selects one of the printing heads 52*a* and 52*b* based on the information of the bag material. Thus, the printing head most suitable for the bag material such as paper or fabric can be selected.

In the sixth modified example, the controller 20 may control the U/I section 18 to present a display image for allowing the user to select a desired article based on goods information stored in a goods information server for storing goods information for respective goods that is connected to a network. In this case, the user can purchase not only an article stored in the goods storing section 10 but also an article that is not stored in the goods storing section 10.

In the seventh modified example, the step for detecting whether or not the charge of using the goods-wrapping apparatus has been inserted (Step S10), that was described with reference to FIG. 2, can be omitted. This step is provided in order to confirm the user's intention to purchase something. By providing this step, it is expected that mischievous use of the goods-wrapping apparatus 200 can be reduced.

In the eighth modified example, the transport direction determination section 46 described with reference to FIGS. 7 and 11 may detect a direction of the bag stored in the bag storing section 63. In a case of using a tray operable to store a plurality of bags as the bag storing section 63, the transport direction determination section 48 may detect a direction of the uppermost bag. When the direction of the bag is detected to be different from the direction in which the closed portion of the bag goes at the head of the bag, the warning section 50 issues the warning that the bag direction is wrong. For example, the warning section 50 may issue the warning to a clerk of the shop at which the goods-wrapping apparatus is set. In this case, the clerk can see that the bag is stored in the wrong direction by the warning from the warning section 50. Thus, the clerk can change the bag direction to the correct direction. Alternatively, in the case where the bag direction is wrong, the condition adjustment section 124 described with reference to FIG. 11 may change the position of the bag so that the closed portion of the bag is transported at the head of the bag. For example, the condition adjustment section 124 may change the position of the bag to such a position that the closed portion of the bag is transported at the head of the bag and the surface of the bag onto which the printing content is to be printed faces the printing head.

In the ninth modified example, the printing section 130 described with reference to FIG. 11 may include a printing position detector operable to detect a mark specifying the printable region in which the printing content can be printed that is provided on the bag, so as to detect where the printing content can be printed on the bag. For example, the mark specifying the printable region may be a bar code including information specifying the position on which the printing content is to be printed. Moreover, the head moving section 58 may move the printing head 56 to the escape position at the position different from the position that is detected to be the printable position by the printing position detector.

As described above, according to the present invention, the goods can be wrapped with the bag onto which the printing content associated with the goods to be wrapped is printed.

What is claimed is:

1. A goods-wrapping apparatus for wrapping a particular article of a plurality of different sized articles, comprising:

a goods storing section operable to store said plurality of different sized articles;

means for selecting a particular article according to an article user instruction and for sensing the size of said selected article;

a goods carrying section operable to carry said articles into said goods storing section and carry said particular article out from said goods storing section;

a printer operable to print a printing content associated with said particular article onto a printing medium based on said particular article, means for storing different sized printing media comprising shopping bags;

a bag size determination section for determining a size of said shopping bag among various sizes based on said particular article's size; and a wrapping section operable to wrap said particular article using said printing medium.

2. A goods-wrapping apparatus according to claim 1, wherein said printer comprises:

a goods database operable to store information related to said articles;

a printing contents data base operable to store printing contents respectively associated with said articles;

a printing content generator operable to select a printing content from said printing contents database and generates the printing content associated with said particular article to be printed on said printing medium, based on said particular article and said goods database; and a printing section operable to print the printing content associated with said particular article generated by said printing content generator onto said printing medium.

3. A goods-wrapping apparatus according to claim 1, wherein said printing medium is a shopping bag, and said wrapping section includes a packing mechanism operable to pack said particular article into said shopping bag onto which the printing content associated with said particular article has been printed.

4. A good wrapping apparatus according to claim 1, further comprising a communication section operable to receive information from an external device and transmit information to an external device, wherein said goods-wrapping apparatus is capable of receiving and transmitting at least one of said printing contents and information regarding said articles that are stored in said external device via said communication section.

5. A goods-wrapping apparatus according to claim 1, wherein the goods-wrapping-apparatus is disposed in a goods-trading apparatus.

6. A goods-wrapping apparatus according to claim 1, wherein said printer includes a plurality of printing heads having different printing characteristics and a head selector which selects one of said plurality of printing heads in accordance with information pertaining to a material of said printing medium.

7. A goods-wrapping apparatus according to claim 1, wherein said printing medium is a shopping bag stored in the goods-wrapping apparatus or provided by a user.

* * * * *